United States Patent [19]

Sainio

[11] Patent Number: 5,056,431

[45] Date of Patent: Oct. 15, 1991

[54] BERNOULLI-EFFECT WEB STABILIZER

[75] Inventor: Jeffrey W. Sainio, Hartland, Wis.

[73] Assignee: Quad/Tech, Inc., Pewaukee, Wis.

[21] Appl. No.: 503,711

[22] Filed: Apr. 3, 1990

Related U.S. Application Data

[63] Continuation-in-part of Ser. No. 340,498, Apr. 19, 1989, Pat. No. 4,913,049.

[51] Int. Cl.[5] ..... B41F 5/04

[52] U.S. Cl. ..... 101/219; 101/227; 226/97

[58] Field of Search ..... 101/211, 484, 229, 227, 101/176, 178–180, 219–220, 228–229, 232; 226/97, 197, 196, 7

[56] References Cited

U.S. PATENT DOCUMENTS

| | | | |
|---|---|---|---|
| 2,848,820 | 8/1958 | Wallin et al. | 226/97 |
| 3,147,006 | 9/1964 | Fulk | 101/227 |
| 3,448,907 | 6/1969 | Otepka et al. | 226/97 |
| 3,549,070 | 12/1970 | Frost et al. | 226/97 |
| 3,622,058 | 11/1971 | Vits | 226/7 |
| 3,979,038 | 9/1976 | Karlsson | 226/97 |
| 4,038,917 | 8/1977 | Deligt | 226/7 |
| 4,069,595 | 1/1978 | Ahlbert et al. | 226/97 |
| 4,096,801 | 6/1978 | Martin | 101/227 |
| 4,137,644 | 2/1979 | Karlsson | 226/7 |
| 4,142,661 | 3/1979 | Nettles et al. | 226/97 |
| 4,240,346 | 12/1980 | Landis et al. | 101/225 |
| 4,321,107 | 3/1982 | Page | 226/7 |
| 4,342,413 | 8/1982 | Reba | 226/7 |
| 4,366,753 | 1/1983 | Glanz et al. | 101/227 |
| 4,406,388 | 9/1983 | Takashi et al. | 226/97 |
| 4,453,709 | 6/1984 | Reba | 226/7 |
| 4,472,888 | 9/1984 | Spiller | 226/97 |
| 4,541,337 | 9/1985 | Schaul | 101/227 |
| 4,698,914 | 10/1987 | Shu et al. | 226/97 |
| 4,787,547 | 11/1988 | Hella et al. | 226/97 |
| 4,787,986 | 11/1988 | Daane et al. | 226/97 |

*Primary Examiner*—Eugene H. Eickholt
*Attorney, Agent, or Firm*—Foley & Lardner

[57] ABSTRACT

A system and method for stabilizing a moving web within a printing press having one or more printing units cooperating to print an image on the web, including an air driven stabilizer structure disposed proximate to the printing units associated therewith for controlling the arc length of blanket follow between the web and one or more of the printing cylinders by creating a Bernoulli effect.

28 Claims, 14 Drawing Sheets

BERNOULLI-EFFECT WEB STABILIZER

TECHNICAL FIELD

The present invention relates, generally, to mechanisms for stabilizing a moving web and to control systems for adjusting the cutoff and color-to-color registration of multicolor web-fed printing press systems by stabilizing and optically scanning the web, and more particularly, to methods and apparatus for noninvasively stabilizing the web without contacting the web, thereby facilitating low depth-of-field scanning of the web in proximity to the print unit.

BACKGROUND OF THE INVENTION

In multicolor web-fed printing press systems, a web of material (e.g., paper) is sequentially driven through a series of printing units, each comprising a plate cylinder and a print cylinder (blanket cylinder). Each blanket cylinder contacts the web in sequence and applies a different color of ink thereto, which colors cooperate to imprint a multicolor image on the web. As the web exits the printing units, the ink is still wet, and thus subject to smearing. Accordingly, before further processing, the web is typically routed through a drying unit to dry the image, heating the web to evaporate various solvents in the ink, then to a chill roller unit to cool the web and set the ink.

To provide an accurate and clear multicolor image, the rotational and lateral position of each blanket cylinder must be precisely aligned, i.e., proper registration of the respective colors must be maintained. In addition, cutoff control registration must be maintained, i.e., the rotary blade used to cut the web into individual signatures must be synchronized to cut between printed images at a precise predetermined location.

Historically, the registration of the various print cylinders in multicolor systems was maintained manually. A pressman would examine signatures (printed images) at the output of the press, and manually enter estimated lateral and rotational offset values into an electromechanical register control system to effect the necessary corrections. Maintenance of color registration in such systems requires the constant attention of the pressman since registration is often lost due to a number of uncontrollable variables in the web material and press hardware. For example, color-to-color registration may be adversely affected by changes in web tension, lateral misalignment of the web, a phenomenon known as blanket follow (discussed below), or any combination thereof.

Automatic registration control systems for multicolor web-fed printing press systems are, in general, known. For example, commercially available closed loop register control systems utilize an optical scanning device cooperating with register marks printed on the web by the individual cylinders, to provide position feedback information indicative of the registration of the respective print cylinders relative to a designated reference print cylinder. More particularly, each print cylinder produces a specific register mark forming part of a register pattern. The optical sensor generates a signal indicative of the register pattern, which is analyzed to determine the lateral and rotational registration of the respective print cylinders vis-a-vis the reference cylinder. Registration error signals, produced in accordance with the registration pattern, are employed to effect position correction of the respective print cylinders.

Examples of such systems are described in EPO Application No. 87 104 973.0, filed Apr. 3, 1987, and U.S. Pat. Ser. No. 849,095 filed Jul. 2, 1986 (now U.S. Pat. No. 4,887,530, issued Dec. 19, 1989), by the present inventor, both applications commonly assigned herewith.

Presently known registration control systems and cutoff control systems are predicated upon the generation of an error signal, which signal is ultimately used to reduce registration error. A system is needed which addresses the source of the registration error, in addition to existing systems for compensating for the error.

Optimal scanning accuracy may be achieved when the web is scanned under conditions yielding relatively little web "weave" (spurious lateral movement of the web, e.g., movement transverse to the direction of web travel, in the plane of the web) and "flutter" (spurious movement of the web in a direction perpendicular to the plane of the web). Preprinted control marks are preferably as small and unobtrusive as possible. However, the ability of the scanner to accurately detect the presence and position of a mark tends to be inversely proportional to mark size; the smaller the mark, the more likely that misregistration or web weave will take the mark outside of the field of view of the scanner. While use of a small and unobtrusive mark can be facilitated by use of a line scanner, as in the aforementioned Sainio U.S. Patent No. (RGS IV), substantial web weave may cause the scanner to lose track of the mark, necessitating reacquisition of the mark by the registration system or, in some cases, physical translation of the scanner to bring the mark back into the field of view of the optical scanner. Reacquisition of the mark can require a significant amount of time in the context of system operation, thereby impairing scanning efficiency.

In addition, optical scanners tend to have a relatively limited depth-of-field, i.e., they are capable of accurately sensing only those images within a predetermined range of distance from the scanner, typically on the order of approximately 0.025 inches. Thus, web flutter in the vicinity of the scanner should be maintained within the limits of the scanner depth-of-field. In prior art systems, flutter is typically maintained within acceptable limits by physically restraining the web, e.g., scanning the web as it wraps around an idler roller, or the like, or in the vicinity of such a wrap.

It is desirable that misregistration be detected as quickly as possible after printing, i.e., that the web be scanned as early in the process after the printing operation as possible. At high web speeds (e.g. 2000 feet per minute), relatively short delays in detecting misregistration can cause considerable wastage.

A principal source of web flutter involves the manner in which the web interacts with the final print cylinder as the web leaves the printing stage. The ink present on the print cylinder is tacky when moist, causing the web to adhere to the outer circumference of the print cylinder. The circumferential surface of the print cylinder comprises a mirror image of the image ultimately printed on the web. In regions of high image density, the adhesion is relatively strong; in regions of low image density, the adhesion is relatively weak. Each individual print cylinder, corresponding to a particular color, applies a portion of the composite printed image to the web. Depending on the color distribution of the composite image, and the density distribution of the respective portions of the composite image applied by each print cylinder, the image transferred by a particular print cylinder may exhibit broad variations in image density along the transverse length of the cylinder and about the circumference of the cylinder. These changes in image density and, hence,.changes in the degree of adhesion between the web and the cylinder, induce instability in the moving web as the web leaves the circumferential surface of the print cylinder.

In addition, the tackiness of a print cylinder changes with time. For example, the degree of tackiness exhibited by a print cylinder are affected by "upstream" print cylinders, i.e., those cylinders which have previously applied an image to the web. In particular, the first print cylinder applies a portion of the composite image to a surface of the web. Thereafter, the web travels to the next print cylinder, whereupon a second portion of the composite image is applied to the web in a different color ink. This second image portion may overlap the first image portion either partially, entirely, or not at all. Subsequent print cylinders thereafter apply different image portions to the web, in different colors of ink, to form the composite image. As a particular print cylinder (subsequent to the first print cylinder) engages the web, some of the non-yet-dried ink from a previous print cylinder is transferred from the web on to the cylinder. In addition, the tackiness of a particular ink may change over time due to, for example, changes in temperature and composition of the ink. Over time, the extent to which the web adheres to a print cylinder due to the tackiness of the ink on the surface of the print cylinder becomes quite substantial, resulting in the "blanket wrap" phenomenon, defined as the arc length through which the web adheres to the circumferential surface of a print cylinder.

The amount of web tension downstream of a cylinder also influences the degree of blanket follow. Localized fluctuations in web tension as the web leaves the last print cylinder cause the web to flutter with an amplitude in the range of about 3/16 to ¼ inch in the vicinity of the final print cylinder, far beyond the maximum depth-of-field variations tolerated by commercially available scanners (e.g. 0.025 inches). Accordingly, to maintain flutter amplitude within the depth-of-field limits of the scanner, flutter amplitude must be reduced by approximately a factor of ten between the point at which the web leaves the print cylinders and the point at which the web surface is scanned.

Conventional web stabilizing techniques, which require physical contact with the web, are not suitable for use upstream of the chill roller; to avoid marring the printed image, physical contact with the web surface is not advisable until after the ink has fully dried. When the web emerges from the dryer, the flutter amplitude is typically less than 0.010 inches, well within the acceptable depth-of-field of available scanners. The drying unit typically supports the horizontally oriented web using pressurized air simultaneously directed at the upper and lower surfaces of the web. This tends to dampen the flutter interjected by the printing units, effectively stabilizing the web during the drying operation. However, changes in the drying air pressure can cause the web to shift up or down relative to the scanner, resulting in unwanted low frequency depth-of-field variations. Moreover, various web characteristics can cause the web to dry at different rates along the length thereof, resulting in non-uniform shrinkage or expansion of the web. This can result in web weave, on the order of about ½ inch.

Web weave is compounded by periodic cleaning of the blanket cylinders (known as "blanket wash"). A blanket wash obliterates registration marks, and often makes the web weave; the marks disappear, then reappear in a different lateral location due to the web weave caused by the blanket wash. Thus, the register control system almost invariably loses "track" of the mark, and must reacquire the mark after a blanket wash. This, of course, delays correction of misregistration. In addition, a web typically travels between 40 and 160 feet between the point at which the web emerges from the printing units and the point at which the web emerges from the dryer. Considerable wastage results from the delay in detecting misregistration. Thus, a technique is needed for stabilizing the web, without contact, prior to the drying operation.

Several mechanisms which turn or support the web without touching it, using a cushion of air, are commercially available. An example is the Tec Systems Tec-Turn(R), which turns a web of paper approximately 90 degrees upward into an overhead dryer. The Tec-Turn unit is adequate for turning, but the distance from the air outlet to the paper may vary from a few hundredths of an inch to ¼ inch or more, depending on paper tension and air pressure. This is adequate for turning the paper but inadequate for keeping the paper within the practical focusing range of a scanner.

Attempts have been made to increase the depth of focus of scanners employing complex optics, thereby facilitating scanning under conditions of high amplitude flutter. For example, the Caligraph Systeme by Bertin may be mounted after the printing groups and before the drier. Such systems, however, have tended to be impractical, overly bulky, and expensive.

Attempts have been made to support the web in the printing unit in a manner which minimizes mechanical contact with the web surface, for example, using a grater roller having a plurality of raised points on the circumferential surface thereof. However, such invasive stabilization mechanisms are unacceptable in many applications where a high level of quality of the finished product is required.

A system is needed which stabilizes the web immediately after the web leaves the terminal print cylinder. In addition, a system is needed which reduces the need for stabilization; that is, a system which controls the amount of flutter induced in the web as the web leaves a print cylinder.

SUMMARY OF THE INVENTION

The present invention facilitates enhanced closed loop register control by stabilizing the printed web as it leaves the final print cylinder, thereby allowing tighter control of color-to-color registration by minimizing the amount of web travel between the printing operation and the scanning operation. In accordance with one aspect of the present invention, a Bernoulli-effect stablizer is disposed proximate the point at which the web leaves the print cylinders. A scanner, mounted in the vicinity of the stabilizer, accurately detects the desired printed image within a narrowly circumscribed depth-of-field.

In accordance with a further aspect of the present invention, the amount of blanket follow associated with one or more cylinders may be precisely controlled. In accordance with this aspect of the present invention, an air bar may be disposed immediately downstream of a print cylinder to reduce variations in the arc length of blanket follow. In a highly preferred embodiment, an air bar may be disposed proximate the upper surface of the web, which surface tends to adhere to the print cylinder. By controlling the air pressure discharged from the air bar, the amount of blanket wrap may be maintained within predetermined limits.

In an alternate preferred embodiment, the air bar may be disposed proximate the lower surface of the web, such that the air discharged from the bar acts in a direction to increase blanket follow. To the extent the degree of blanket follow may be precisely controlled, and hence variations in blanket follow minimized, color-to-color registration, cutoff control, and many other process parameters may be greatly enhanced.

BRIEF DESCRIPTION OF THE DRAWING

A preferred exemplary embodiment of the present invention will hereinafter be described in conjunction with the appended drawing, wherein like numerals denote like elements, and.

DETAILED DESCRIPTION OF PREFERRED EXEMPLARY EMBODIMENTS

Figure 1:
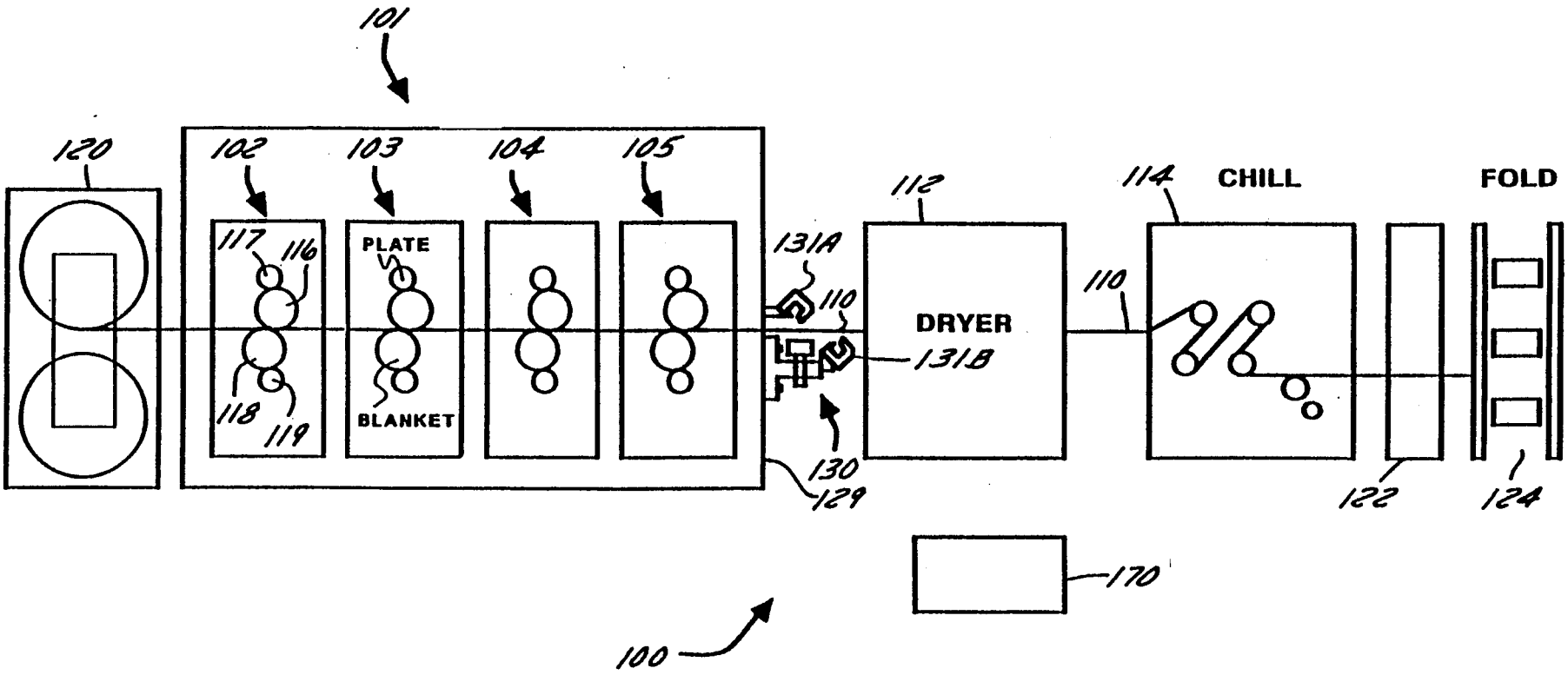
FIG. 1 is a block schematic front elevation view of a printing system in accordance with the present invention.

Referring now to FIG. 1, a web-fed printing system 100, preferably including a printing press 101 and comprising a plurality of serially disposed conventional printing units 102, 103, 104, and 105, operates upon a driven web 110. In a web offset printing press, each of printing units 102–105 advantageously includes an upper blanket cylinder 116, an upper plate cylinder 117, a lower blanket cylinder 118, and a lower plate cylinder 119. Web 110, typically paper, is fed from a reel stand 120 through each of printing units 102–105 in sequence and thereafter through a dryer unit 112 and chill unit 114. Web 110 is then suitably guided through a coating unit 122 and a folding station 124 which folds and separates the web into individual signatures.

Printing units 102–105 cooperate to imprint multicolor images on the upper and lower surfaces of web 110. Each printing unit 102–105 prints an associated color of ink; typically the first sequential print unit 102 prints the color black, and subsequent units 103–105 print other colors such as cyan, magenta, and yellow. Print unit 105 is referred to herein as the terminal print unit. Each of the lateral and rotational positions of upper and lower plate cylinders 117, 119 is separately controlled by electric motors (not shown) to precisely register the respective images generated by the individual printing units.

In accordance with one aspect of the present invention, a non-invasive stabilizer is employed to facilitate scanning of the web, between the individual printing units 102–105, immediately upon exit from press 101, or otherwise between press 101 and dryer 112. In the embodiment of FIG. 1, a non-invasive stabilizer 130 is advantageously mounted to a side frame 129 of printing press 101. One or more optical scanning units 131A, 131B, associated with a register control system 170, such as, for example, a Quad/Tech RGSIV register control system, are disposed to scan web 110 in a stabilized area in the vicinity of stabilizer 130. Register control system 170 provides appropriate signals to the electric motors of the plate cylinders to precisely control lateral and rotational position of the upper and lower plate cylinders, respectively.

By employing a non-invasive stabilizer 130, i.e., a stabilizer which does not make physical contact with the web, scanning can be advantageously effected in the vicinity of the print units without smearing the ink. In view of the proximity of the scanners to the printing units, not only are long time delays between printing and detection of misregistration substantially eliminated, but web weave is minimized. Stabilizer 130 can be any mechanism which dampens flutter of web 110 to within acceptable limits for scanning (i.e., within the depth-of-field of units 131A, 131B), without causing the image imprinted on the respective surfaces of web 110 to smear. Stabilizer 130 can, for example, comprise respective forced-air conduits, disposed on either side of web 110, including apertures to generate respective oppositely directed air streams impinging on both the upper and lower surface of web 110 with sufficient force to stabilize the web. Alternatively, stabilizer 130 may comprise a mechanism for inducing an electric or a magnetic field, which field acts upon the web to impart an electromagnetic force thereupon. In this embodiment, the web substraight may have magnetically or electrically active particles disbursed therethrough or, alternatively, the ink may comprise electrically or magnetically active particles. In accordance with the preferred embodiment, however, stabilizer 130 employs a Bernoulli-effect to stabilize web 110.

Figure 2:
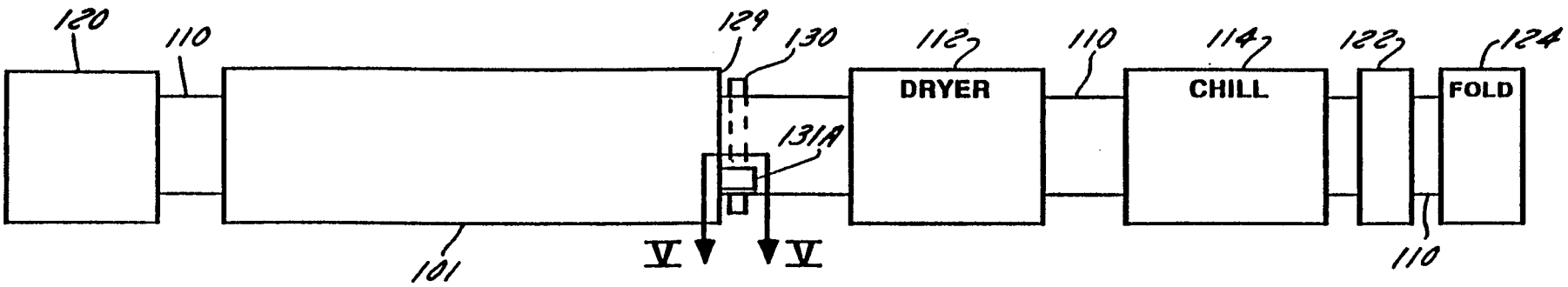
FIG. 2 is a block schematic top plan view of the printing press of FIG. 1.
Figure 3:
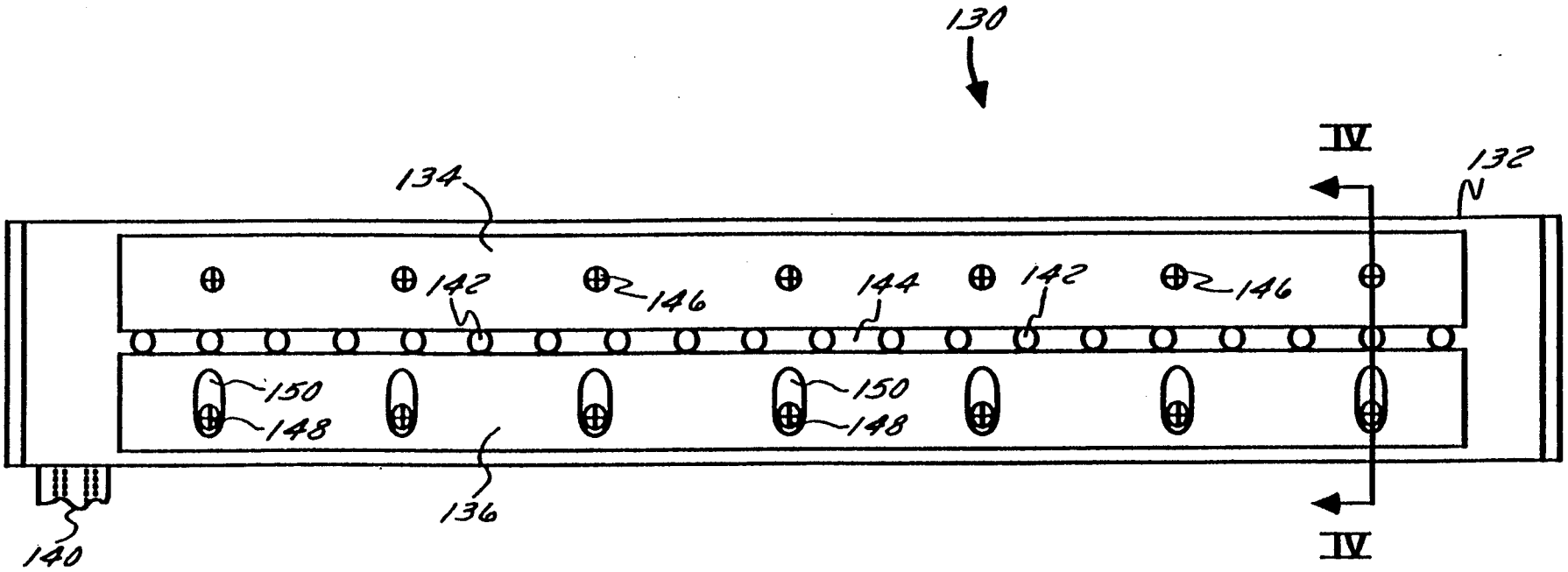
FIG. 3 is a top plan view of the stabilizer of FIGS. 1 and 2.

As shown in FIGS. 2 and 3, stabilizer 130 preferably comprises a forced air conduit bar 132 disposed transverse to the direction of web travel, extending across the width of web 110. Stabilizer 130 directs a stream of pressurized air, transverse to the plane of the web, against the surface of the web. As the forced air impinges upon the moving web, the air moves horizontally along the downward facing surface of the web, away from stablizer 130. This high velocity air creates a zone of reduced static pressure adjacent the surface of the web, thereby pulling the web toward the stabilizer. At the same time, the outward pressure of the forced air, in conjunction with the pocket of high velocity air trapped between the web surface and the stabilizer surface, prevents the web from contacting the stabilizer. Accordingly, as flutter induces the web away from the stabilizer, the Bernoulli effect pulls the web back towards the stabilizer. Conversely, as flutter attempts to direct the web into contact with the stabilizer, the trapped air pushes the web away therefrom. As will be explained, a plurality of stabilizer units may be simultaneously employed, for example, above and below the web, as desired. For purposes of illustration, the preferred embodiment will be described in the context of a single stabilizer disposed underneath the web.

Figure 4:
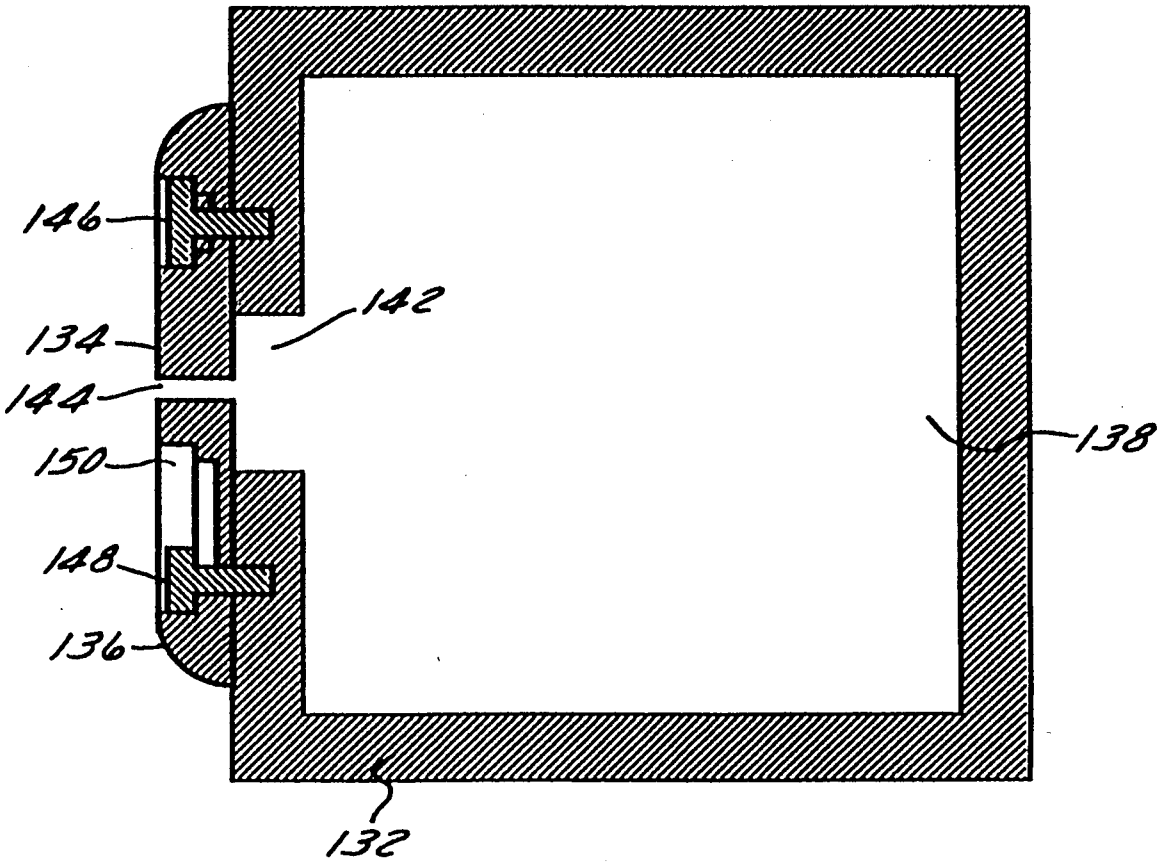
FIG. 4 is a cross-section view of the stabilizer shown along line IV—IV of FIG. 3.

Referring now to FIGS. 3 and 4, conduit bar 132 is suitably square in cross-section and of a length, e.g., 52 inches, in excess of the width of web 110. A hollow interior chamber 138 spans the length of the bar, the cross-sectional area of chamber 138 being sufficient to accomodate a desired air flow, suitably on the order of 2 to 10 PSI, preferably within the range of 2 to 4 PSI. Chamber 138 communicates with a compressed air source (not shown) through an air inlet junction 140 suitably disposed at an end of bar 132.

A controlled air stream outflow is provided from the surface of conduit bar 132 facing web 110. A series of air discharge holes 142 are formed through the wall of bar 132 along the length of bar 132. Respective gap adjusting strips 134 and 136 are secured to the surface of bar 132. Adjusting strips 134 and 136 cooperate to define a linear gap 144 therebetween generally overlying holes 142, preferably of a length corresponding to the width of web 110. Holes 142 and gap 144 define the path of discharged air from conduit bar 132, and thus the air stream against web 110. The use of holes 142, and overlying strips 134, 136, to provide and control the air flow is particularly advantageous; it provides a structure mechanically strong enough to operate at relatively high air pressures without deformation of the air outlet. The square cross section of conduit 132 facilitates formation of holes 142, and the securing of strips 134 and 136.

Proper selection of the width of gap 144 allows precise control over the velocity of the discharge air passing therethrough. For a given air pressure within chamber 138, decreasing the width of gap 144 increases the discharge air speed; conversely, increasing the width of gap 144 decreases the discharge air speed.

The width of gap 144 is preferably such that gap 144 provides a significant resistance to air flow, greatly in excess of the resistance generated by the presence of web 110 in the vicinity of gap 144. Thus, air flow through gap 144 will be substantially constant across the length of the gap whether or not web 110 extends across the entire length of gap 144. Webs of varying widths are therefore readily accomodated; gap 144 is of a length corresponding to the widest web contemplated to be encountered. The width of gap 144 is suitably on the order of eight to fifteen thousandths of an inch (0.008 to 0.015 inch).

Strip 134 is secured to bar 132 in any convenient manner, for example by bolts 146. Alternatively, strip 134 may be held in place by screws, welding, or may be formed integral with bar 132, as desired. Adjusting strip 136, on the other hand, is preferably slideably secured to bar 132, for example by respective slotted screws 148 received within slots 150. In this way, the width of gap 144 may be adjusted by disposing and securing strip 136 at a predetermined desired distance from strip 134. Of course, if desired, both strips 134 and 136 may be fixedly secured to conduit bar 132.

Figure 5:
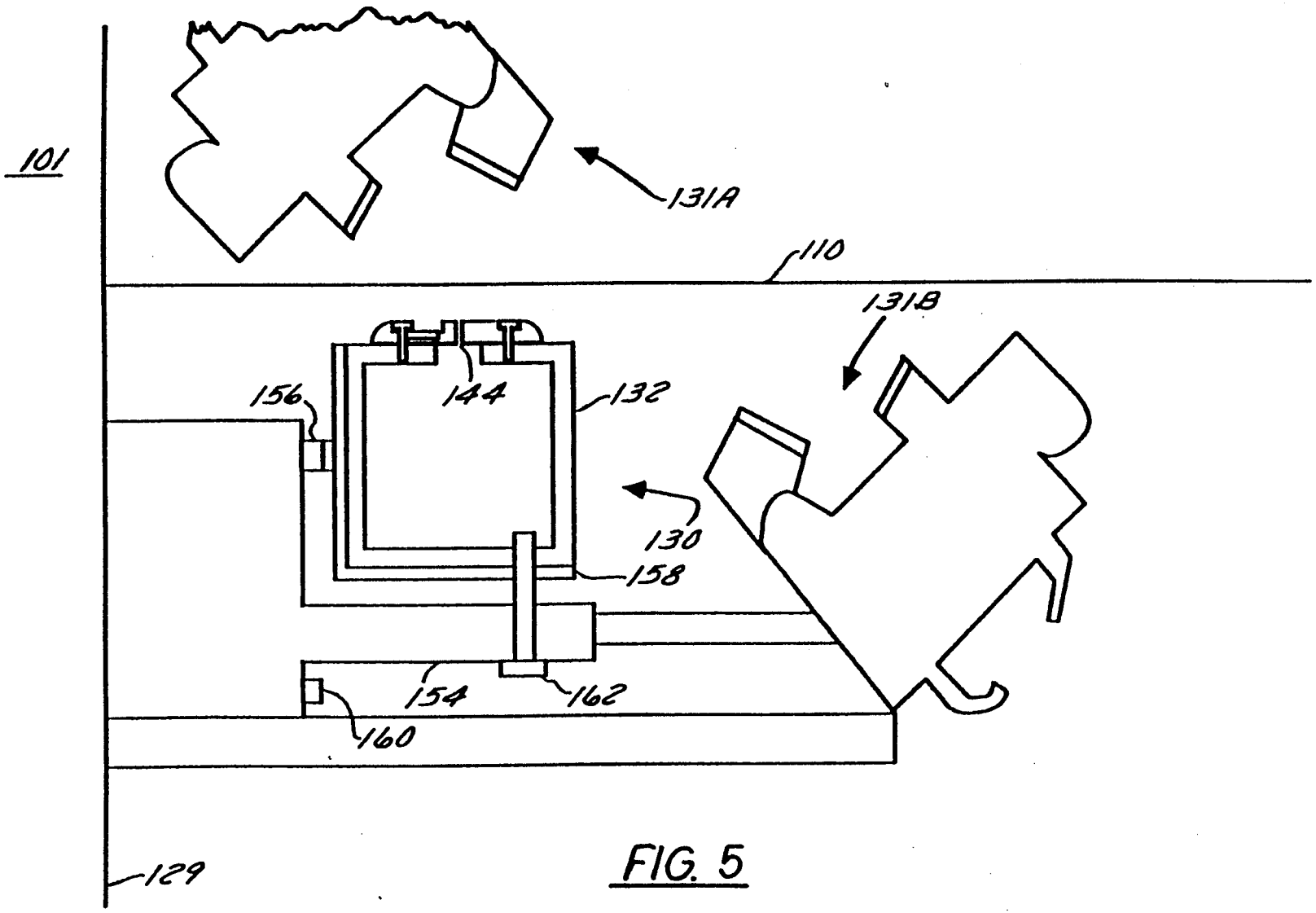
FIG. 5 is a cross-section view of the stabilizer shown mounted to the press taken along line V—V of FIG. 2.

Referring now to FIG. 5, stabilizer apparatus 130 is advantageously mounted to press 101 near the point at which web 110 leaves press 101. In a preferred embodiment, a mounting member 154 is affixed to press frame 129, for example, by an upper bolt 156 and a lower bolt 160. An L-shaped bracket 158 is secured to mounting member 154, for example by bolt 156 and a medial bolt 162. Bar 132 of stabilizer 130 is received within L-shaped bracket 158 and secured thereto by, for example, one or both of bolts 156 and 162. Mounting member 154 and L-shaped bracket 158 suitably span approximately the entire length of bar 132, and a plurality of bolts 156, 160, and 162, spaced apart along the length of mounting member 154, may be used as necessary.

Scanner 131B is suitably mounted to sidewall 129 of press 101, or to mounting bracket 154, and disposed to focuse upon an are of web 110 in the vicinity of stabilizer 130. Scanner 131B is suitably focused on an area of the web within, e.g., five or six inches from stabilizer 130. Scanner 131A is suitably mounted to the side of press 101 on the opposite side of web 110 from stabilizer 130. Scanner 131A is suitably focused on a portion of web 110 overlying stabilizer 130. The point of focus is preferably not directly over gap 144; there tends to be little if any Bernoulli effect immediately overlying gap 144, causing a slight pucker in the web immediately above gap 144. Accordingly, the point of focus preferably overlies one of adjusting bars 134 or 136.

Figure 6:
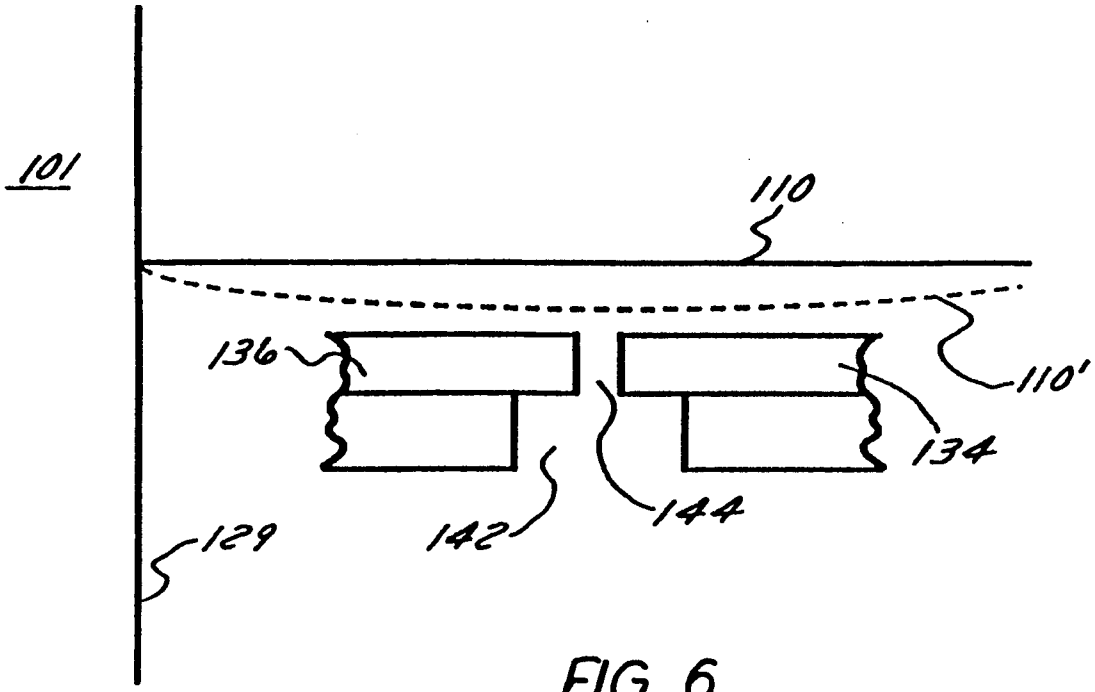
FIG. 6 is an enlarged view of the stablizer FIGS. 3–5 shown interacting with a moving web.

Referring now to FIG. 6, stabilizer 130 is advantageously mounted such that the upper surfaces of respective adjusting strips 134 and 136 are disposed approximately 3/16 of an inch from web 110 when the stabilizer is in the off condition. When the stabilizer is turned on, compressed air is forced upwardly through respective holes 142 and gap 144, ultimately impinging upon the downward facing surface of web 110. The pressure of the discharged air which is confined between the upper surfaces of strips 134, 136 and the underside of web 110 creates a cushion of horizontally moving air; the velocity of this air creates a zone of reduced static pressure between the stabilizer and the web in accordance with the Bernoulli principle. The static pressure above the web, of course, remains unaffected by the operation of the stabilizer. Consequently, web 110 is drawn towards the stabilizer to the position 110', as indicated by the phantom line in FIG. 6. The upward force of the discharged air, in conjunction with the cushion of trapped air between web 110' and adjusting strips 134, 136, prevents web 110' from contacting the stabilizer. Proper adjustment of web tension, air pressure, and the width of gap 144 permits the distance between web 110' and stabilizer 130 to be maintained within the range of about 0.001 to 0.010 inches, and most preferably about 0.007 inches.

Figure 7:
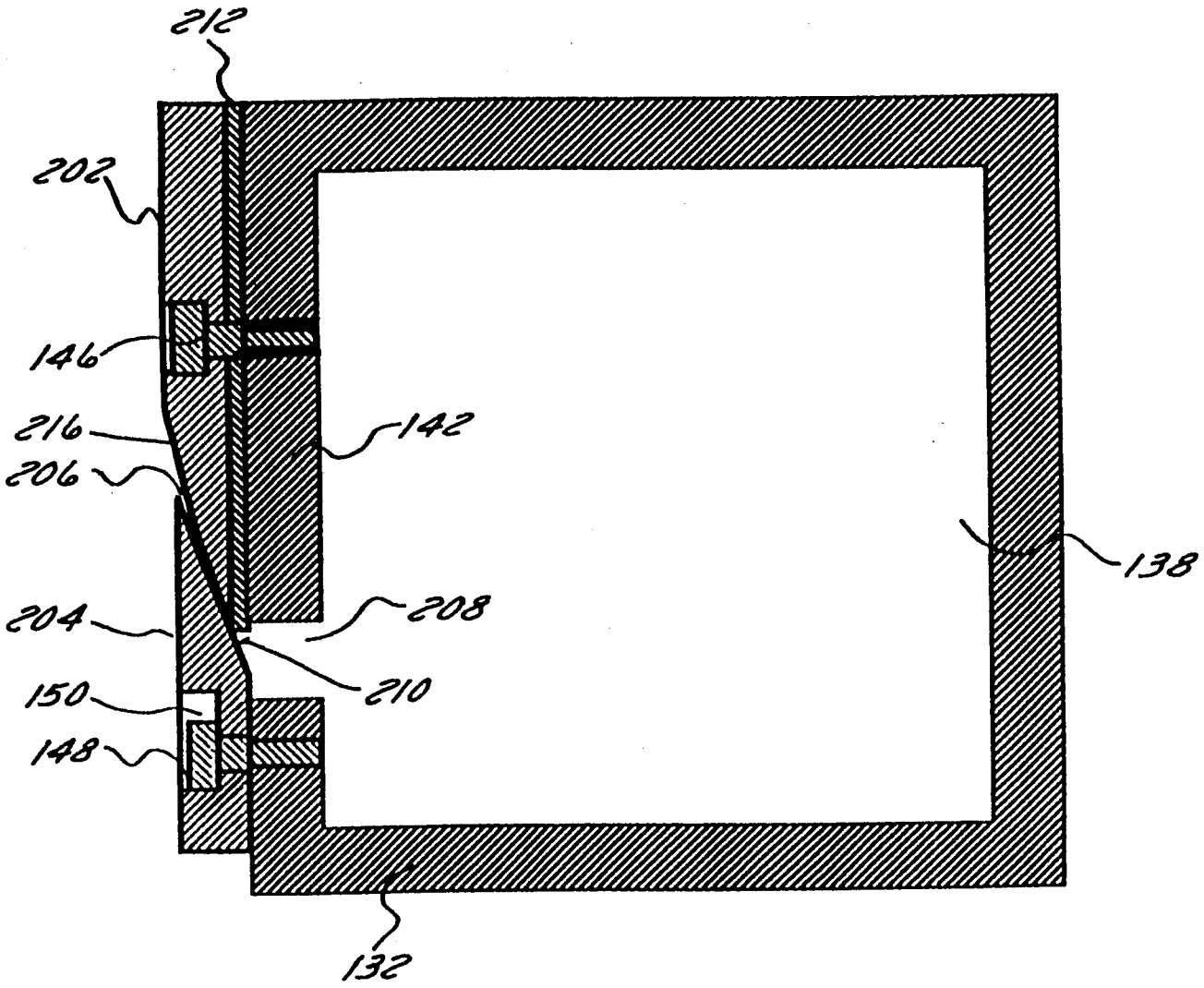
FIG. 7 is a top plan view of an alternate embodiment of the stabilizer of FIGS. 1 and 2.
Figure 8:
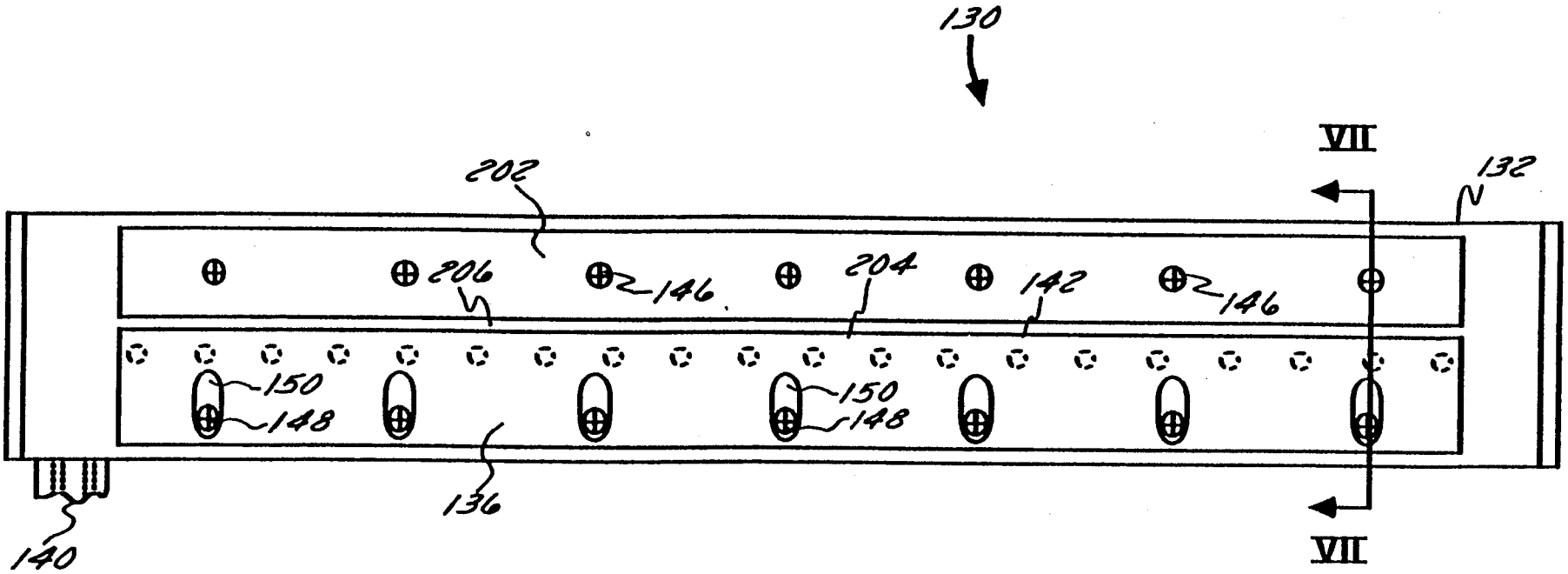
FIG. 8 is a cross-section view of the stablizer shown along line VIII—VIII of FIG. 7.

Referring now to FIGS. 7 and 8, an alternate exemplary embodiment of the stabilizer bar in accordance with the present invention suitably comprises respective gap adjusting strips 202 and 204 defining an angled air gap 206 therebetween. Gap adjusting strip 204 is suitably secured to conduit bar 132 by slotted screw 148 received within slot 150, as described above in connection with strip 136.

Gap adjusting strip 204 advantageously comprises an angled portion 210 defining an acute angle with the surface of conduit bar 132 upon which respective holes 208 are disposed. Gap adjusting strip 202 is advantageously secured to conduit bar 132 in any convenient manner, for example by bolts 146. A spacer 212 is advantageously disposed intermediate gap adjusting strip 202 and conduit bar 132 such that, when stabilizer 130 is mounted to side frame 129 of press 101 as depicted in FIG. 9, the height of gap adjusting strip 202 exceeds that of strip 204 by an amount approximately equal to the thickness of spacer 212, for example, approximately 0.060 inches.

Figure 9:
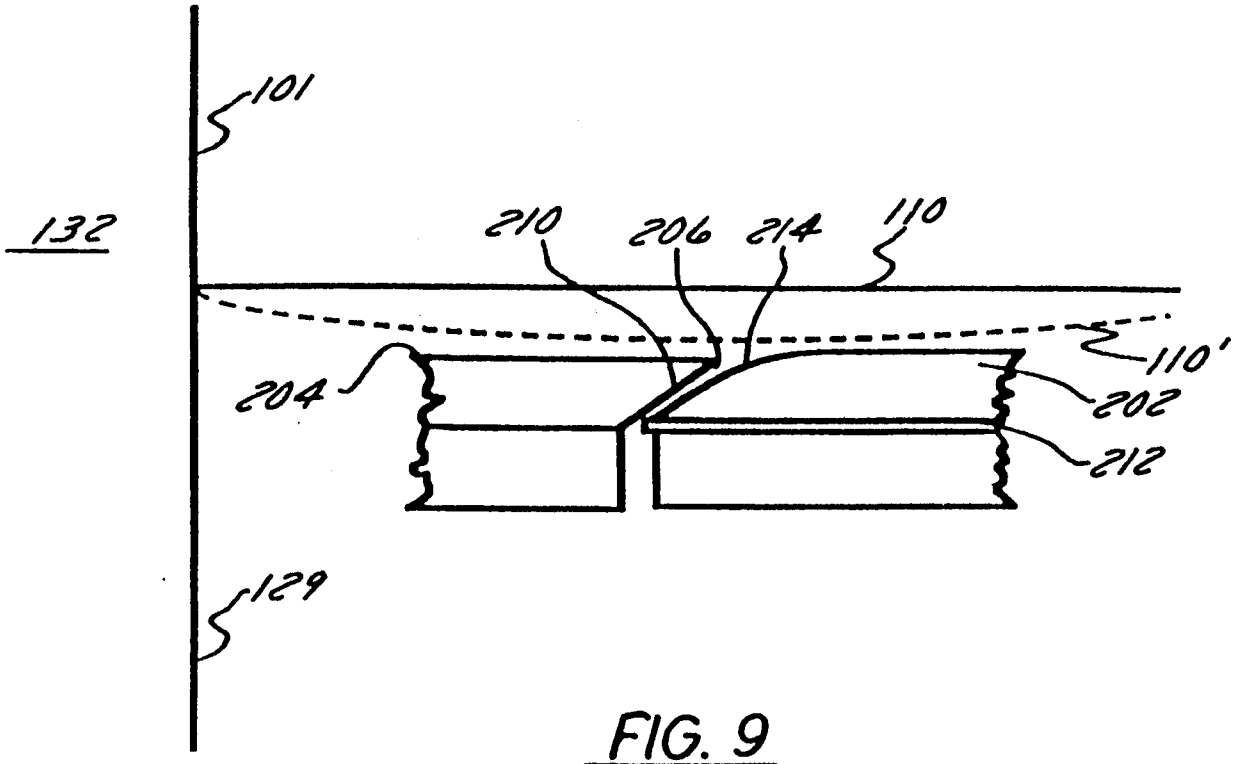
FIG. 9 is an enlarged view of the stabilizer of FIGS. 7–8 shown interacting with a moving web.

With continued reference to FIGS. 7–9, strip 202 suitably comprises an inclined portion 214 defining the downstream edge of gap 206; angled portion 210 of strip 204 comprises the upstream edge of gap 206. As a result of the angled configuration of gap 206, the stream of discharged air from stabilizer 130 impinges web 110 at an acute angle with respect to the plane of travel of web 110. In this manner, a relatively insignificant amount of discharge air enters the region between the web and the upper surface of strip 204, the majority of the discharge air being directed between the web and strip 202. Consequently, the Bernoulli effect is largely confined to that portion of stabilizer 130 downstream of gap 206. Any debris which may fall from the web, for example sputtered ink, dust, and the like, will thus be blown downstream by the airstream discharged from gap 206.

To avoid contact between strip 204 and web 110' when web 110' is in the control (stabilization) zone, i.e., approximately 0.007 inches from adjusting strip 202 during operation of stabilizer 130, it is advantageous for strip 204 to be disposed out of (beneath) the control zone by an amount approximately equal to the thickness of spacer 21.

In accordance with a further aspect of the present invention, the inventor has determined that by positioning the stabilizer bar sufficiently close to a print cylinder, the level of blanket follow may be precisely controlled, thereby minimizing a number of problems associated with blanket follow.

Figure 10A:
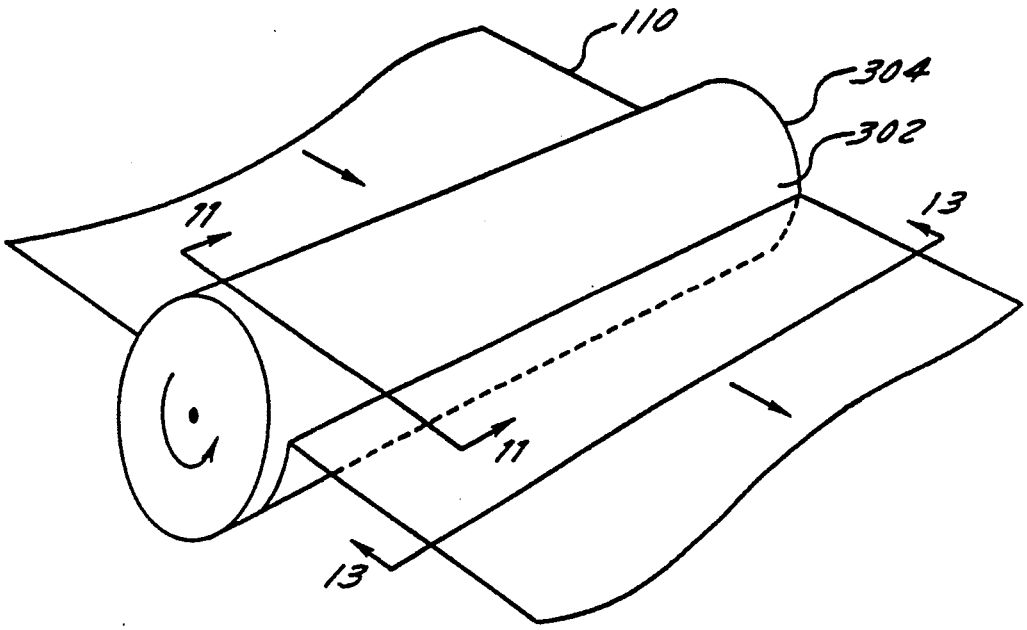
FIG. 10A is a perspective view of a web exhibiting blanket follow as it leaves a print cylinder.
Figure 10B:
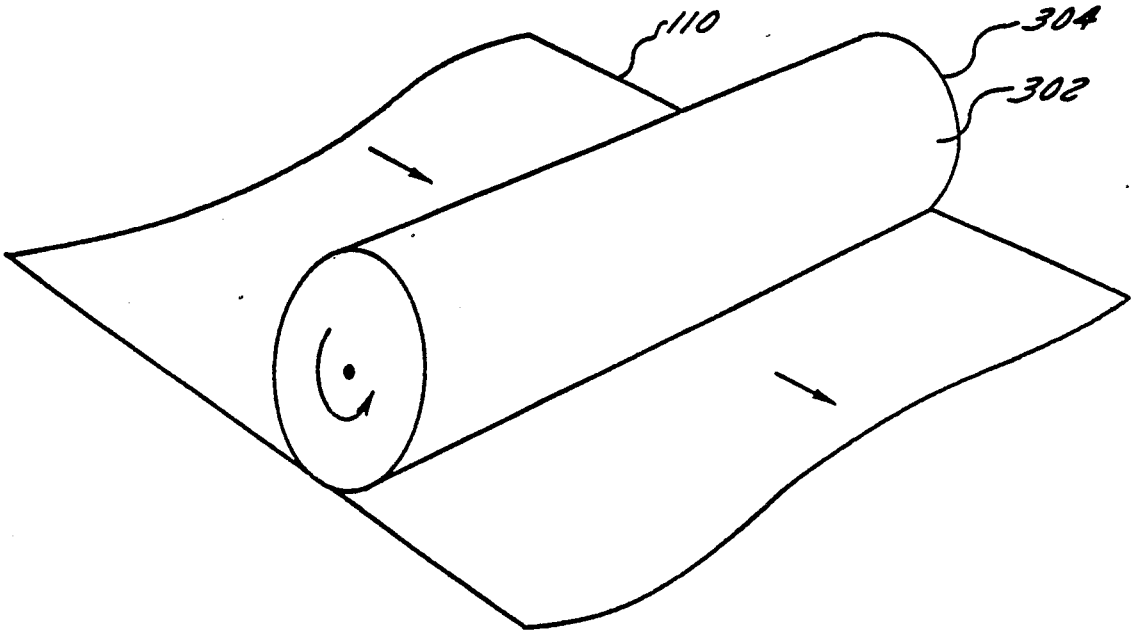
FIG. 10B is a perspective view of the web and print cylinder of FIGURE 10A, shown immediately after a blanket wash.
Figure 11:
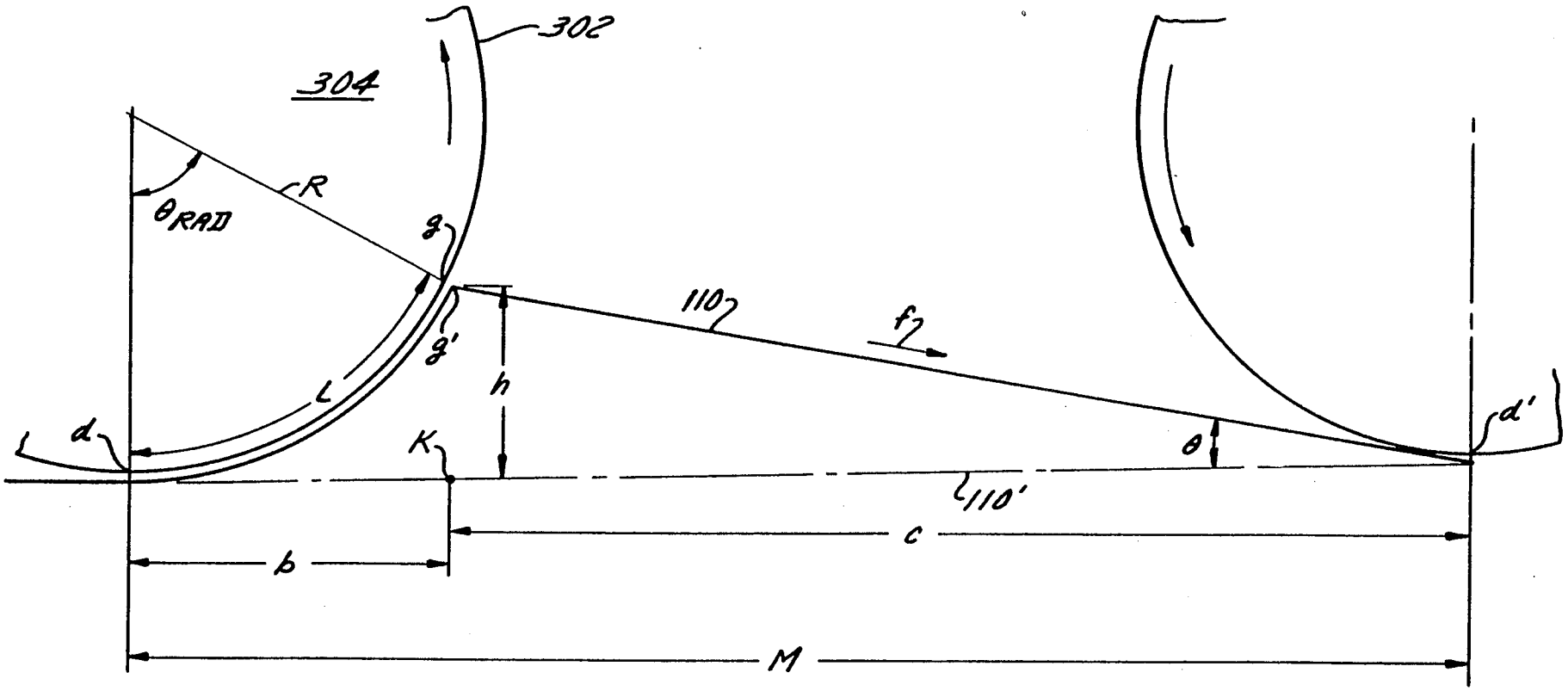
FIG. 11 is a perspective view taken along line 11—11 of FIG. 10A.

Referring now to FIGS. 1 and 10–11, the mechanism by which blanket follow affects web travel will now be described. As best seen in FIGS. 1 and 10A, web 110 follows a generally straight web path through respective print units 102, 103, 104, and 105. As web 110 passes through print unit 102, it passes over blanket cylinder 118 and under blanket cylinder 116. Inasmuch as blanket cylinder 116 is disposed forwardly of blanket cylinder 118, for example by approximately four (4) inches, blanket follow is generally limited to blanket cylinder 116.

Blanket cylinder 116 accumulates ink, and becomes increasingly tacky over extended periods of press operation. As previously discussed, this phenomenon is progressively more pronounced in subsequent print units; i.e., the print cylinders in print unit 103 have more ink on their circumferential surface and are thus generally more tacky than those in print unit 102, and so on, due to the web transferring ink from previous blanket cylinders to subsequent blanket cylinders.

As best seen in FIG. 10A, the tackiness of the ink causes web 110 to wrap around (follow) a portion of the circumferential surface 302 of an exemplary cylinder 304. The extent to which web 110 "follows" cylinder 304 is a function of, inter alia, web tension downstream from cylinder 116, web and blanket surface characteristics, ink tackiness, and the amount of ink present at the interface between web 110 and circumferential surface 302.

As will be further discussed, tackiness (and thus the extent of follow) often varies across the transverse length of a cylinder. In accordance with one aspect of the present invention, the stabilizer bar may be disposed proximate one of the print cylinders such that blanket follow is minimized. Alternatively, the stabilizer bar may be disposed proximate a print cylinder such that blanket follow is held constant, regardless of the absolute "base line" magnitude of blanket follow. Small amplitude variations in blanket follow will nonetheless be observed; however, maintaining the amplitude of these variations within a narrow range about the base line greatly improves the quality of the printed image.

As discussed in greater detail below, blanket wash is a principal source of high amplitude variations in blanket follow. That is, the extent to which web 110 wraps around circumferential surface 302 of print cylinder 304 changes greatly after a blanket wash.

During the course of the printing process, debris tends to accumulate on the respective surfaces of the blanket cylinders resulting in decreased quality of the printed product. Specifically, airborne debris such as dust and lint adhere to the ink on the surfaces of the web and print cylinder. In addition, small particles carried by the web, particularly minute wood fragments ("flecks"), are transferred to the printing surface of the blanket cylinder and adhere thereto. These particles result in perceptible imperfections on the printed image, often referred to as "hickeys."

To enhance print quality, the blanket cylinders are periodically washed to remove extraneous particles therefrom. This procedure, known as "blanket wash", is performed at the discretion of the pressman, and typically coincides with a splicing operation. The splicing operation results in considerable wastage of press time and press paper; thus, it is an appropriate time to wash the blanket cylinders, thereby reducing the total combined wastage due to the splicing and blanket wash procedures.

In addition to removing extraneous debris from the blanket cylinders, the blanket wash operation removes partially dried ink from the non-image regions of a blanket cylinder. As a result, adhesion between web 110 and blanket cylinder 304 is dramatically reduced, as shown in FIG. 10B, such that blanket follow is substantially reduced.

With particular reference to FIG. 11, the extent to which web 110 deviates from a nominal web path 110' (phantom line) and follows circumferential surface 302 of an exemplary print cylinder 304 may be represented by an arc length L. More particularly, arc length L extends along circumferential surface 302 from a point d (corresponding to the point along nominal web path 110' at which web 110 would disengage circumferential surface 302 of print cylinder 304 in the absence of adhesion due to ink tackiness), to a point g (corresponding to the point at which the web tension is sufficient to overcome the adhesive forces and pull web 110 from the print cylinder surface). Point g' designates a point along the length of web 110 corresponding to point g on circumferential surface 302.

With continued reference to FIG. 11, point g is disposed a distance h above nominal web path 110'. More particularly, point g is disposed a distance h above a nominal point k along web path 110'. Upon being pulled from circumferential surface 302 of print cylinder 304, point g on web 110 travels downstream along a line f to a point d' corresponding to an arbitrary contact point downstream from print cylinder 304. Point d' may correspond to a subsequent print cylinder, typically spaced from the preceding cylinder by 89 inches (if print cylinder 304 is not the terminal print cylinder) or, alternatively, point d' may be associated with, for example, a chill roller. In any event, point d' is sufficiently far downstream from print cylinder 304 such that the cosine of the small angle between line f and nominal web path 110' approaches unity and, thus, the length of line f may be said to be approximately equal to the length of line c.

The total distance traveled by any point on web 110 between points d and d' in the presence of blanket follow is equal to the combined distances of arc length L and line f. The total distance traveled by the same point in the absence of blanket follow, on the other hand, corresponds to a straight line along web path 110' having a nominal distance M. Moreover, nominal distance M may be defined as the sum of respective distances c and b, where b is the distance between respective points d and k, and c is the distance between points k and d'.

Recalling that the length of line f is approximately equal to the length of line c, the difference between 1) total web travel from point d to point d' in the presence of blanket follow, and 2) total web travel from point d to point d' the absence of blanket follow may be expressed as the difference between arc length L and the length of line b.

The present inventor has determined that an arc length L of blanket follow on the order of 0.1–4.0 inches may be observed in printing presses operating at approximately 2,000 feet per minute. For purposes of the ensuing discussion, an exemplary nominal blanket follow of 2.65 inches is employed, that is $$L=2.65$$

A wrap-around angle $\theta$ (rad) associated with arc length L may then be determined as follows, where R=7.25 inches (the radius of a typical blanket cylinder):

$$\begin{aligned} \theta \text{ rad} &= L/R \\ \theta \text{ rad} &= 2.65/7.25 \\ &= .3655 \text{ rad;} \end{aligned}$$

such that $$\theta\,(^\circ)=20.94^\circ$$

Having determined arc angle $\theta$, the length of line b may be expressed as follows:

$$\begin{aligned} b &= R \sin \theta \\ &= 7.25 \sin (20.94^\circ) \\ &= 2.59. \end{aligned}$$

Thus, the increase in web travel due to blanket follow for this example may be expressed as:

$$\begin{aligned} L - b &= 2.65 - 2.59 \\ &= .060 \end{aligned}$$

As blanket follow decreases from an arc length L (prior to blanket wash) to a small fraction of arc length L (subsequent to blanket wash), the distance traveled by web 110 between points d and d' is very quickly reduced by approximately 0.060 inches. The present inventor has determined that this change in distance traveled by web 110 between points d and d' immediately following a blanket wash has a profound impact on various operating parameters, most notably cut-off control.

More particularly, given a blanket follow of 2.65 inches prior to blanket wash, the net effect of a blanket wash is that the web "jumps" forward by approximately 0.060 inches in addition to the steady state forward velocity of the web. This disrupts the cut-off control mechanism, which precisely controls the position at which the web is separated into individual signatures. Presently known cut-off control mechanisms are capable of controlling the position of respective cut lines to within approximately 0.005 inches of a nominal signature length position. When the web "jumps" forward by 0.060 inches, cut-off control problems are greatly exacerbated.

Thus, although it is desirable to minimize the extent to which the web follows the print cylinder, it is still more desirable to minimize variations in the extent to which the web follows the print cylinder; variations in web follow have a significant effect on the quality of the printed product. That is, once a "base line" blanket follow is established, maintenance of that base line prevents "jumps" in web travel thereby enhancing register, cut-off and other control parameters.

Figure 13C:
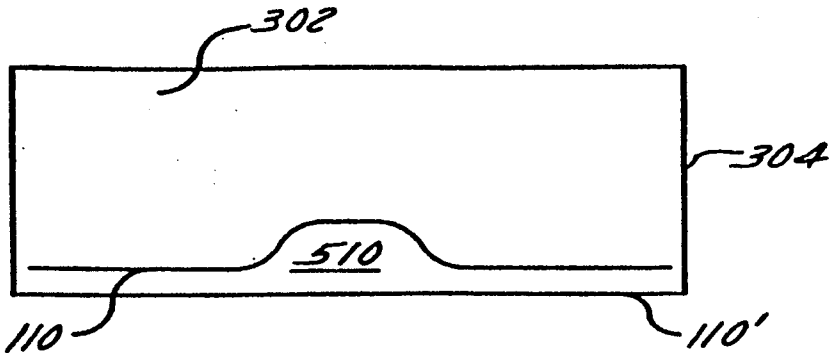
FIGS. 13A–C are schematic cross-section views of various blanket follow configurations, taken along line 13—13 in FIGURE 10A.
Figure 13A:
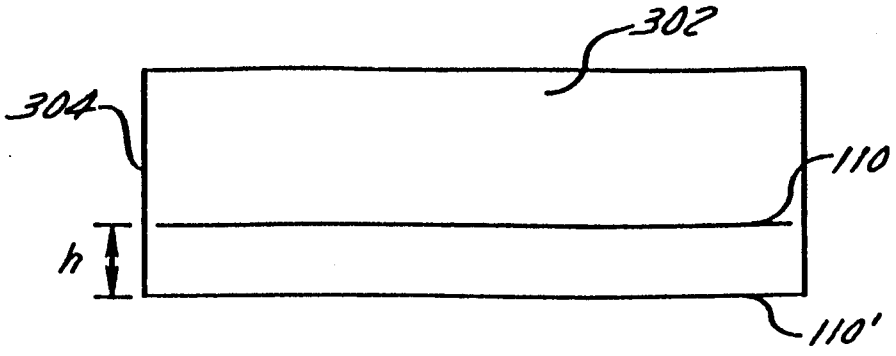
Figure 13B:
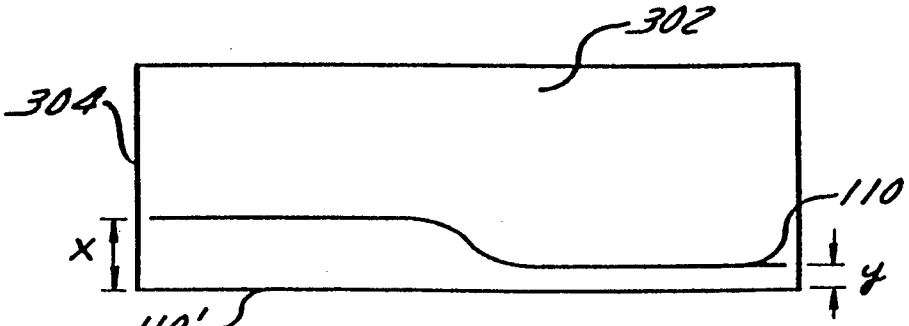

Referring now to FIGS. 13A–C, a typical web of paper is approximately thirty-three (33) inches wide in a direction perpendicular to web travel. (The term "transverse", as used herein, is understood to mean "not parallel"; thus, a perpendicular orientation is also "transverse"). A typical blanket cylinder has a length, i.e., an axial dimension perpendicular to web travel, on the order of thirty-eight (38) inches.

As discussed above, the arc length L of blanket follow varies over time as a function of, inter alia, ink tackiness, web tension, and blanket wash frequency. The present inventor has further determined that the blanket follow arc length at any instant in time may vary along the transverse direction of the print cylinder. This is primarily due to the fact that the color distribution (ink density) varies along the length of the print cylinder in accordance with, inter alia: 1) the image to be transferred to the web by a particular print cylinder; and 2) the ink transferred by the web to the cylinder from previous cylinders.

The effect of varying color density along the length of a print cylinder is schematically illustrated in FIGS. 13A–C. FIG. 13A represents an essentially constant ink density distribution along the length of print cylinder 304. The height h (see FIG. 11) corresponds to the distance above nominal web path 110' at which web 110 is pulled from circumferential surface 302. The blanket follow illustrated in FIG. 13A corresponds to a point in the printing cycle prior to blanket wash; i.e., the print and non-print regions of the cylinder exhibit approximately equal blanket follow due to the tackiness of the non-print regions since the previous blanket wash. As long as blanket follow remains at height h, cut-off control and color-to-color control may be maintained. Following a blanket wash, however, the height h of blanket follow is immediately reduced, requiring that cut-off control and registration control to be reestablished. It should be noted that, regardless of the magnitude of blanket follow height h, maintenance of a constant blanket follow height h greatly reduces many of the print quality problems associated with blanket wash.

Immediately subsequent to a blanket wash, the configuration of FIGS. 13A assumes the configuration shown in FIG. 10B. Thereafter, the web initially "follows" the print regions of the cylinder until acceptable print quality resumes (within 30 second after blanket wash). Over time, the web follow pattern again returns to the configuration shown in FIG. 13A.

Referring now to FIG. 13B, an example is shown wherein the blanket follow height immediately subsequent to blanket wash is not constant along the length of cylinder 304. More particularly, the degree of tackiness exhibited by the left side of circumferential surface 302 is greater than the degree of tackiness exhibited by the right side of circumferential surface 302. This difference in tackiness may be due to a number of factors, for example the ink distribution of the image applied to cylinder 304 by its associated plate cylinder, the length of time since the previous blanket wash, and the respective color density patterns applied to web 110 by previous print cylinders and transferred to circumferential surface 302 by the web.

The blanket follow pattern illustrated in FIG. 13B has the effect of "pulling" the web in the direction of high blanket follow (high blanket follow corresponds to dimension "x", low blanket follow corresponds to dimension "y" in FIG. 13B). This is referred to as web weave, or the tendency of the web to deviate laterally from the desired web path. As previously discussed, various correction motors are employed to adjust the lateral and rotational position of each print cylinder to maintain color-to-color registration in the presence of, inter alia, web weave.

Following a blanket wash, the blanket follow pattern shown in FIG. 13B quickly changes to that shown in FIG. 10B, i.e., blanket follow is nearly eliminated in the non-printing areas of the cylinder. As discussed above in connection with FIG. 11, the blanket follow height h is substantially reduced, causing the high blanket follow portion of the web to "jump" forward by an amount in the range of, for example, 0.060 inches. However, because of the non-constant blanket follow height exhibited by web 110 in FIG. 13B, only the left side of the web jumps forward; blanket wash has very little effect on the low density color regions exhibiting minimal blanket follow (right side of FIG. 13B). If cylinder 304 is the terminal cylinder, web 110 may travel in the range of 40–120 feet before it is mechanically stabilized. This 40–120 foot "lever arm" amplifies the 0.060 inch jump by a factor on the order of 10–40. This results in a nearly instantaneous downstream lateral shift of web 110 of up to several inches. If this lateral shift occurs within the drier, the web may contact the side of the drier, resulting in web breakage.

If the print cylinder shown in FIG. 13B is not the terminal print cylinder, the registration correction motors associated with subsequent print cylinders may compensate for the web weave induced by the differential blanket follow, but such correction is obliterated upon a blanket wash. In addition, the phenomenon observed in FIG. 13B may occur at each print cylinder, having an additive effect on lateral web movement.

Following a blanket wash, color-to-color control and cut-off control are typically lost and thereafter reestablished over time. However, as the tackiness of the high ink density portion of circumferential surface 302 subsequently increases during the printing process, the configuration shown in FIG. 13B is reestablished. Thus, web weave, cut-off control, and registration may exhibit cyclic variations as a function of blanket wash.

Referring now to FIG. 13C, circumferential surface 302 exhibits a low degree of tackiness at the left and right sides of cylinder 304, and a high degree of tackiness in the central region. Consequently, blanket follow is high near the center 510 of cylinder 304 and low at the outside regions. This tackiness distribution induces a "tent" shape in the web downstream of the print cylinder, effectively shortening the width of the web. This is a particularly vexing problem because there are no known mechanisms for reestablishing the proper web width. Thus, color-to-color registration becomes particularly problematic.

If the tenting phenomenon becomes sufficiently pronounced, web 110 may corrugate along the high density/ low density color transition regions. Upon a blanket wash, the tenting phenomenon is temporarily eliminated, yet the corrugation may remain. Presently known techniques for "stretching" the web back to its desired width generally involved increasing web tension along the direction of web travel. This has the effect of reducing the high blanket follow in the central portion of the cylinder, but high web tension may result in web breakage.

The present inventor has determined that the quality of the printed product may be improved by controlling either, but preferably both of, the following two factors:

1. the nominal (baseline) arc length of blanket wrap associated with each point along the length of a print cylinder such that a substantially uniform arc length is exhibited along the cylinder; and
2. the magnitude of changes in the baseline arc length associated with each point along the cylinder.

More particularly, to the extent the foregoing parameters may be maintained within narrow limits, cut-off control and register control may be enhanced, and web deviation problems, for example web weave, web flutter, jumping, and high amplitude lateral shifting, may be significantly reduced.

The present inventor has determined that the degree of blanket follow, as well as the magnitude of changes in the arc length of blanket follow for each point along the length of the print cylinder may be precisely controlled by positioning the stabilizer bar adjacent the print cylinder; and, preferably, immediately downstream of the print cylinder.

Figure 14:
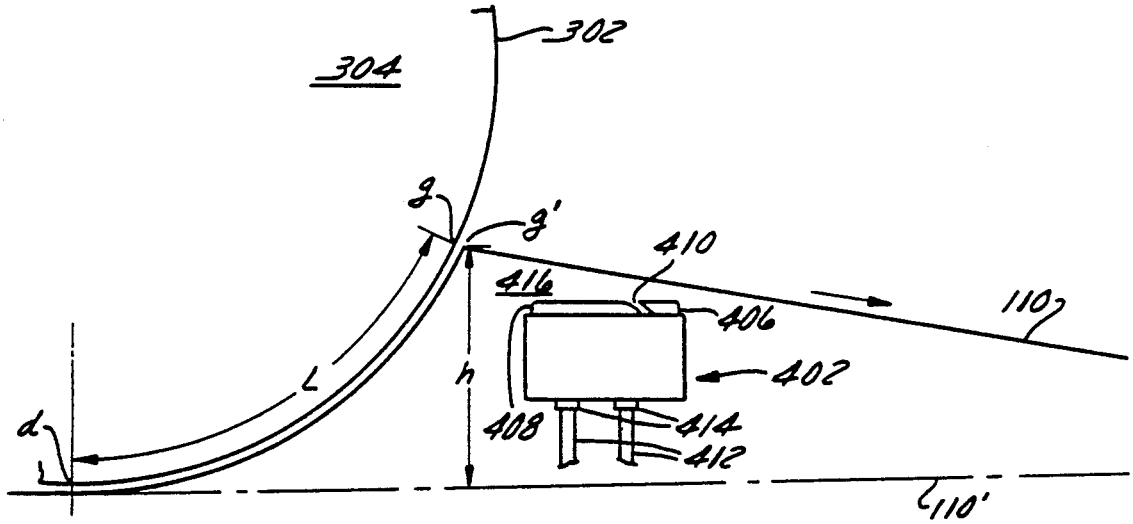
FIG. 14 is an exemplary schematic cross-section view, similar to FIG. 11, of a stabilizer bar disposed proximate a print cylinder and configured to maintain an essentially constant blanket follow arc length.

Referring now to FIG. 14, a stabilizer bar 402 (and the compressed air stream (not shown) exhausted from stabilizer bar 402) is disposed in predetermined relation with web 110, nominal web path 110', and cylinder 302.

Stabilizer 402 may be rigidly secured in place by one or more rods 412 extending from, for example, the printing unit housing. One or more adjustable fasteners 414 may be employed to adjust the height of stabilizer 402 above nominal web path 110'.

Figure 12:
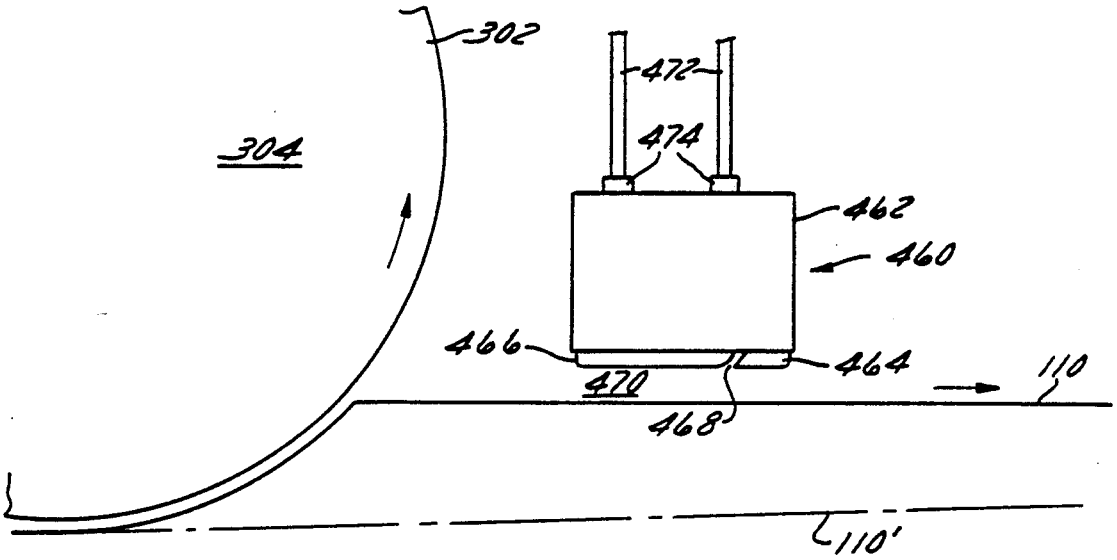
FIG. 12 is an exemplary schematic cross-section view of a stabilizer bar disposed above the web proximate the print cylinder and configured to maintain an essentially constant blanket follow arc length.
Figure 15:
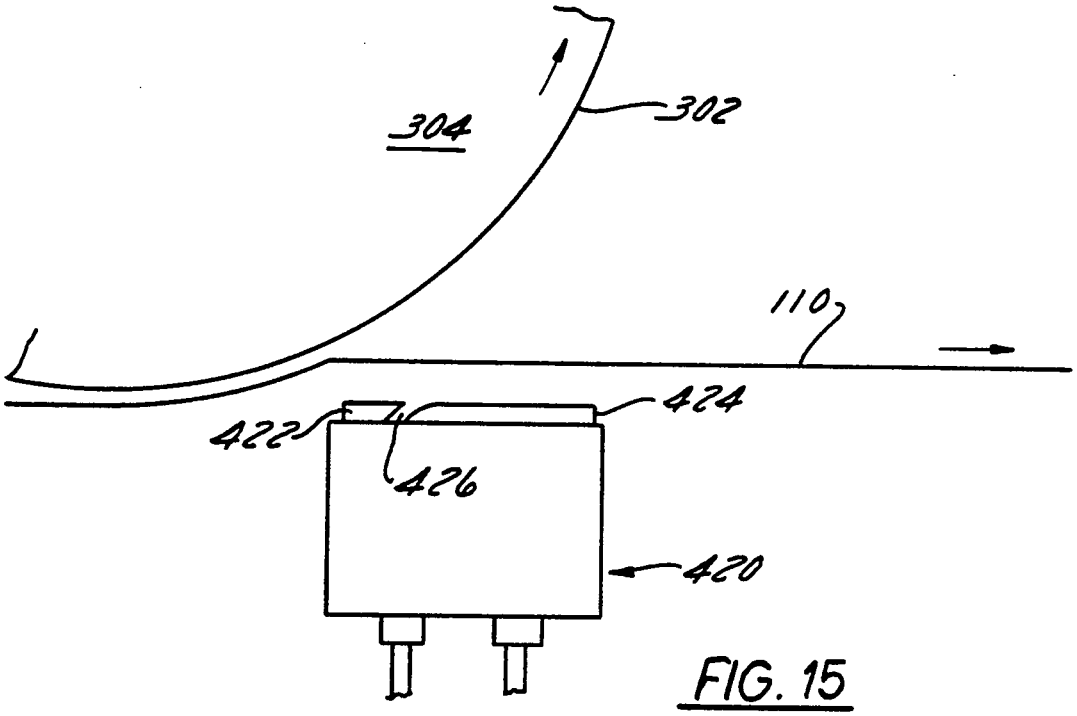
FIGS. 15–16 are exemplary schematic cross-section views of alternate preferred embodiments of a stabilizer bar disposed proximate a print cylinder and configured to maintain an essentially constant arc length of blanket follow.
Figure 16:
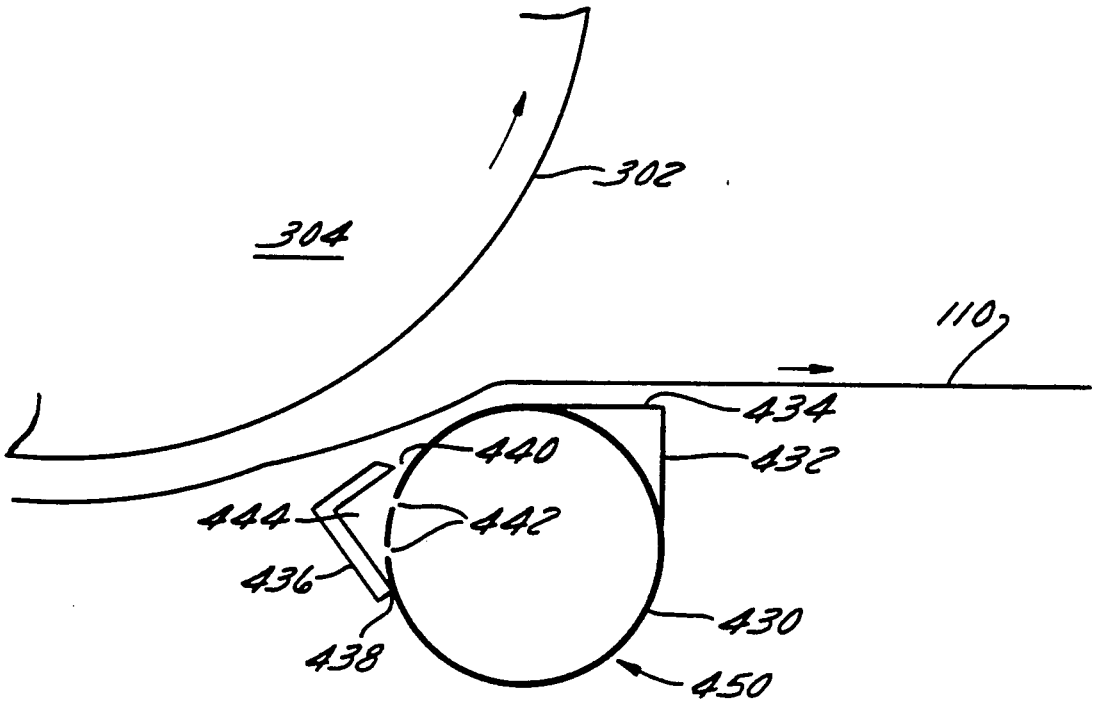

Stabilizer 402 is advantageously similar to stabilizer 130 discussed in conjunction with FIG. 7. Particularly, stabilizer 402 suitably comprises respective gap adjusting strips 406 and 408 defining an angled air gap 410 therebetween. The upper surface of strip 408 is the relevant aerodynamic surface in the embodiment shown in FIG. 14, although the trajectory of web 110 and the angle formed by web 110 at cylinder 302 is greatly exaggerated for clarity. Specifically, web 110 is essentially horizontal in the region above strip 408, as seen in FIGS. 12 and 15–16. The thickness of strip 406 is beneficially significantly less than that of strip 408, inasmuch as the upper surface of strip 406 plays a limited (if any) role in the aerodynamic mechanism; rather, strip 406 functions to appropriately define and direct the compressed air stream. In a preferred embodiment, air gap 410 is directed rearwardly so that a zone 416 of compressed air is created in the region between web 110 and strip 408, thereby reducing the likelihood that web 110 may contact the upstream edge of stabilizer 402 proximate cylinder 302.

As discussed previously, web 110 follows print cylinder 302 along an arc length L between points d and g on circumferential surface 304. Thus, point g' on web 110 is pulled from circumferential surface 304 at a height h above nominal web path 110'. During the printing process, several factors may cause the arc length (L) of blanket follow to change over time. In general, anything which might cause a change in the adhesive force between the web and cylinder may cause a variation in arc length L. For example, the web's response to a gradual change in tackiness of circumferential surface 304, or due to a blanket wash.

As the arc length L of blanket follow tends to increase or decrease in response to a change in the adhesive force between circumferential surface 304 and web 110, the height h above nominal web path 110' at which point g' on web 110 separates from circumferential surface 304 will also tend to change. As previously noted, in the absence of stabilizer 402, a change in height h may result in point g' jumping downstream (for example in response to a blanket wash), creeping upstream (as the adhesive force between surface 304 and web 110 increases), or may result in a lateral shift in web 110, resulting in, inter alia, the cut-off and registration control problems discussed supra.

Stabilizer bar 402 substantially inhibits variations and the arc length of blanket follow by providing a cushion of air between strip 408 and web 110 and between strip 406 and web 110. In the event of a decrease in, for example, web tension or the tackiness of circumferential surface 304, either of which tend to decrease the arc length of blanket follow, the "cushion" of moving air between stabilizer bar 402 and web 110 substantially inhibits a reduction in the height h at which point g' on web 110 leaves the surface of print cylinder 302. The steady-state tension in the web will tend to inhibit an increase in arc length L.

In the event the arc length of blanket follow tends to increase beyond the point at which web tension can effectively inhibit such increase, a zone of reduced static pressure may be created by the moving air between strip 408 and web 110 and between strip 406 and web 110 in accordance with the Bernoulli effect, described above. If desired, the stabilizer bar may be configured to create a zone of reduced static pressure of sufficient magnitude to substantially inhibit an increase in arc length.

Accordingly, by properly positioning stabilizer 402 with respect to print cylinder 302, variations in the arc length of blanket follow may be precisely controlled. Specifically, these variations may be maintained within a narrow range in accordance with, inter alia, the following factors: the amount of air pressure discharged from air gap 410; the horizontal surface area of respective strips 406 and 408; the height of air gap 410 above nominal web path 110'; the baseline arc length L, web tension downstream of print cylinder 302; the tackiness of circumferential surface 304; and the distance between print cylinder 302 and stabilizer bar 402.

In particular, an exemplary air pressure maintained within stabilizer bar 402 and discharged from air gap 410 thereof may range from, for example, one (1) to four (4) psi, and preferably about 2.5 psi. The length (i.e., transverse to the direction of web travel) of respective strips 406 and 408 should be sufficient to stabilize the entire transverse dimension of web 110, for example, on the order of thirty-three (33) inches or more, and preferably about thirty-eight (38) inches. The width of strip 408 (i.e., the width along the direction of web travel when stabilizer bar 402 is disposed perpendicular to the direction of web travel) is preferably in the range of one (1) to four (4) inches, and preferably about two (2) inches.

The height of the upper surfaces of strip 408 above nominal web path 110 may be varied by selectively positioning respective fasteners 414 to achieve optimum control. In a preferred exemplary embodiment, the upper surface of strip 408 may be maintained above nominal web path 110' in the range of up to one (1) inch and preferably about 0.25 inches. Proper positioning of stabilizer bar 402 above nominal web path 110' advantageously places the upper surfaces of strips 406 and 408 in the range of about 0.005 to 0.025 inches, most preferably about 0.010 inches from web 110.

To maximize control over arc length L, it is desirable to position stabilizer bar 402 as close to print cylinder 302 as practicable. In a preferred exemplary embodiment, the upstream edge of stabilizer 402 may be advantageously disposed in the range of about 1/16 to three (3) inches from circumferential surface 304, more preferably about ⅛ to one (1) inch, and most preferably about ¼ inches. However, stabilizer 402 should also be positioned to minimize the likelihood of contact between web 110 and stabilizer 402.

Proper selection of the foregoing parameters maintains web 110 within a range of about 0.005 to 0.025 inches from the upper surface of stabilizer 402. This corresponds to variations in arc length L up to about three (3) inches, and preferably on the order of 0.1 to 0.6 inches, and optimally about 0.1 to 0.3 inches, as opposed to 2.65 inches without control. Control of the magnitude of arc length L in this manner significantly enhances print quality by reducing many of the deleterious effects associated with higher amplitude changes in blanket follow.

The ability of stabilizer 402 to control variations and the arc length of blanket follow is particularly important following a blanket wash. By reducing the magnitude of variations in the arc length of blanket follow subsequent to a blanket wash, the various control problems normally associated with blanket wash are substantially eliminated.

One skilled in the art will appreciate that the precise orientation of stabilizer 402 may be modified from that shown in FIG. 14. Stabilizer 402 may be oriented to accommodate, for example, spacial constraints associated with the particular printing press in conjunction with which stabilizer 402 is employed. Additionally, stabilizer 402 may be placed above web 110 or, alternatively, respective stabilizer bars may be placed above and below web 110, wherein one of the stabilizer bars is staggered forwardly with respect to the other. Other modifications, such as may be devised by those of ordinary skill in the art, are also within the scope of this invention.

Referring now to FIG. 12, an alternate embodiment of the present invention comprises a stabilizer 460 disposed above web 10 proximate print cylinder 302. Stabilizer 460 suitably comprises a generally hollow bracket 462 having respective gap adjusting strips 464 and 466 secured to be lower surface thereof. Respective strips 464 and 466 cooperate to define an angled air gap 468 therebetween. Stabilizer 460 is advantageously secured in place by respective support bars 472. Respective adjusting fasteners 474 may be manipulated by the operator to secure stabilizer 460 at a predetermined height above web 110.

Referring now to FIG. 15, an alternate embodiment of the present invention comprises a stabilizer bar 420, including respective adjusting strips 422 and 424 defining an angled air gap 426 therebetween. By selecting a relatively narrow strip 422, air gap 426 may be positioned proximate the left side of stabilizer bar 420, facilitating a downstream orientation of air gap 426. The cushion of moving air exhausted from gap 426 and directed over strip 424 resists the downward motion of web 110 with sufficient force to minimize the likelihood of contact between web 110 and strip 422.

Referring now to FIG. 16, an alternate embodiment of a stabilizer bar 450 is configured to minimize the likelihood of inadvertent contact between the web and the stabilizer bar as the arc length of blanket wrap tends to decrease, for example after a blanket wash. Stabilizer bar 450 suitably comprises a tubular member, such as a pipe 430 having a shelf member 432 and an angled member 436 secured to the exterior thereof. Pipe 430 advantageously comprises a radial cross-section, for example a circular cross-section. In this way, those portions of stabilizer 450 which are disposed upstream of the air cushion may be positioned remote from the path traveling by web 110 as arc length L decreases. Thus, the mechanical complexity of stabilizer 450 is minimized while reducing the likelihood of contact between stabilizer 450 and web 110, inasmuch as the strongest air flow force (i.e., immediately adjacent air gap 426) is disposed near the surface of the cylinder, where web forces are greatest.

Pipe 430 suitably includes one or more apertures 442 which discharge compressed air from the cavity defined by pipe 430 into a compression region 444 defined by angle member 436 and pipe 430. Angle member 436 is suitably secured to pipe 430 at a junction 438, for example by brazing, welding, or the like. In addition, angle member 436 may be secured to pipe 430, for example by bolts or screws (not shown) spaced apart along the length of pipe 430. In this manner an aperture 440 is defined by angle member 436 and pipe 430. Moreover, the foregoing bolts (not shown) may suitably be manipulated to define a predetermined gap width associated with aperture 440.

Compressed air is discharged through apperture 440 and enters the region between the combination of pipe 430 and shelf 432 and web 110, creating a cushion of air which substantially inhibits web 110 from contacting either pipe 430 or shelf 432.

Shelf member 432 suitably comprises a substantially horizontal surface 434 for "supporting" web 110. As previously discussed, the velocity of the discharged air from apperture 440 preferably creates a reduced zone of static pressure between stabilizer 450 (particularly horizontal surface 434) and web 110. This reduced zone of static pressure draws web 110 downwardly towards stabilizer 450 in the event the arc length of blanket follow tends to increase, for example due to increased tackiness of circumferential surface 304. Conversely, the cushion of air disposed between stabilizer 450 (particularly horizontal surface 434) and web 110 substantially inhibits web 110 from descending downwardly as the arc length of blanket follow tends to decrease, for example subsequent to a blanket wash.

The configuration of stabilizer 450 shown in FIG. 16 is particularly advantageous in that angle member 436, apperture 440, and the portion of pipe 430 upstream of shelf number 432 are configured to minimize the likelihood of contact between web 110 and stabilizer 450 in response to sudden decreases in the arc length of blanket follow, such as observed following a blanket wash. In addition, the airstream is oriented to minimize premature drying of the ink.

A subtle yet recurring problem associated with blanket follow surrounds the phenomenon known as "dot slur", or the tendency for the printed image to smear as the web is pulled from the print cylinder.

In water-based lithography, the image on a plate cylinder is comprised of an image region and a background region. The image region of the plate cylinder comprises a hydrophobic substrate (repels water), whereas the background region comprises a hydrophilic (attracts water) substrate. During the printing process, a water-based solvent and the ink are simultaneously applied to the print cylinder surface. As the print cylinder rotates, the ink adheres to the image (hydrophobic) regions unimpeded by the solvent (which does not adhere to the image region). The solvent is attracted to the background region, thus preventing the ink from adhering to the background region, creating a defined inked image surrounded by a non-inked background image.

During the printing process, water is deposited on the surface of the paper web; the web absorbs the water and stretches in the direction of web travel in accordance with the tension maintained in the web. Web tension is difficult to control precisely, thus, web tension and, hence, web stretch, tend to vary during the printing process.

Depending on such factors as, for example, the arc length of blanket follow, web and blanket surface characteristics, and image density, portions of the web which follow the blanket are stretched while in contact with the blanket cylinder (i.e., the wrap-around area of the web). The dots comprising the printed image, which are typically on the order of 14,400 dots per square inch, may become smeared, resulting in a localized darkened image in the area of the smear, known as "blanket release problem: Minimizing blanket follow appreciably improves the blanket slur problem. By reducing blanket follow in accordance with many of the embodiments discussed herein, dot slur may be concomitantly reduced.

It will be understood that the above description is of preferred exemplary embodiments of the present invention, and that the invention is not limited to the specific forms described. For example, the web need not be secured to the side frame of the printing press; the stabilizer may be disposed at any convenient point along the web path, although proximity to the source of web instability, i.e., the print cylinders, is advantageous. Furthermore, although the preferred embodiment employs a Bernoulli-effect stabilizer, any suitable technique for dampening web flutter which does not smear the ink is satisfactory, for example, an electric or magnetic field which coacts with electrically or magnetically responsive particles in or on the web. In addition, any suitable gas may be used in place of air, for example in the event certain gases may be desirable for effecting or preventing various chemical reactions with the web or any coatings applied thereto. If desired, the gas stream discharged from the stabilizer bar may be heated or chilled to enhance processing of the web. In particular, the present invention contemplates webs other than those used in the printing process. For example, systems used in fabricating webs of fabric, wallpaper, floor covering, sheet metal, or any other process in which a flexible web cooperates with one or more processing stations which tend to induce fluxuations in the baseline position of the moving web. These and other substitutions, modifications, changes, and omissions may be made in the design and arrangement of the elements without departing from the scope of the appended claims.

I claim:

1. A system for controlling the registration and cutoff of a moving web in a printing press, comprising:

a printing unit having a print cylinder about which the web follows, disposed to print an image on the web and to direct the web along an actual web path in a manner tending to induce fluctuations in the position of said web in a direction transverse to a nominal plane of said web path; and a noninvasive stabilizer means mounted immediately adjacent said printing unit between said nominal plane of said web path and said actual web path for utilizing gas pressure and the Bernoulli effect to maintain said web within a preselected range of distance from said nominal plane of said web path controlling the degree of follow of said web with respect to said print cylinder and substantially inhibiting the generation of said fluctuations in said web to enhance the registration and cutoff control.

2. The system of claim 1 wherein said stabilizer means comprises means for creating a zone of reduced gas pressure for drawing said web in a direction normal to the plane of said web.

3. The system of claim 2 wherein said stabilizer means comprises means for creating a Bernoulli effect.

4. The system of claim 1, wherein said stabilizer means comprises at least one bar, including a forced-gas conduit having a gas outlet, disposed transverse to the direction of web travel and extending across the width of said web.

5. The system of claim 1, wherein said stabilizer means comprises a forced-gas conduit having a gas outlet for distributing gas under pressure disposed approximately 0.010 inches below the surface of said web.

6. The system of claim 1, wherein said stabilizer means is disposed up to about 0.25 inches from said printing unit.

7. The system of claim 4, wherein said bar is configured to direct a stream of pressurized gas, in a direction transverse to the plane of said web, against the upper surface of said web.

8. The system of claim 1, wherein said stabilizer means comprises a stabilizer bar having a rectilinear cross section.

9. The system of claim 8 wherein said bar is disposed across the width of said web and has a length at least as great as the width of said web.

10. The system of claim 9, wherein said bar comprises a hollow interior chamber spanning the length of said bar.

11. The system of claim 1, wherein said stabilizer means comprises a non-invasive stabilizer bar having a plurality of holes disposed on a surface thereof, and respective first and second adjusting strips secured to said surface defining a linear gap overlying said holes, wherein said holes and said gap define a path of discharged gas from said bar.

12. A printing press comprising:

an inked print cylinder having a circumferential surface configured to print an image on a web moving along a web path tending to induce fluctuations in said web in a direction transverse to a nominal plane of said web path;

means for effecting contact between said circumferential surface of said print cylinder and said web, said web tending to releasably adhere to a portion of said circumferential surface along an arc having a variable arc length and follow an actual web path depending upon the tension of said web downstream of said print cylinder and the amount and tackiness of the ink between said web and said circumferential surface; and means mounted immediately adjacent said arc for controlling the magnitude of said variable arc length and substantially inhibiting the formation of said fluctuations in said web.

13. The printing press of claim 12, wherein said controlling means is disposed along said web path downstream from said print cylinder.

14. The printing press of claim 12 wherein said web comprises a substantially planar, elongated substrate having a first surface contacting said print cylinder and an oppositely disposed second surface, and wherein said controlling means is disposed proximate said second surface of said web.

15. The printing press of claim 12, wherein said controlling means comprises means for maintaining the magnitude of said variable arc length within a preselected distance range.

16. The printing press of claim 12, wherein said controlling means comprises means for noninvasively stabilizing the web.

17. The printing press of claim 12, wherein said controlling means comprises means for maintaining said arc length substantially constant along the length of said print cylinder.

18. The printing press of claim 12, wherein said controlling means comprises means, extending transversely across said web path adjacent said print cylinder, for directing a stream of compressed air at a surface of the web.

19. A system for guiding a web along an actual path in a printing press, said press including means for printing an image on said web, tending to induce fluctuations in the position of said web in a direction transverse to a nominal plane of said web path; said system improved wherein the system further comprises:

means connected to said printing press and located above said nominal plane of said web path and said actual web path for reducing the magnitude of the induced fluctuations to within a predetermined distance range with respect to said web path.

20. The system of claim 19, wherein said predetermined distance range is on the order of 0.025 inch.

21. The system of claim 19 wherein said reducing means comprises a stabilizer bar extending transversely across said web path.

22. An apparatus for stabilizing a flexible web moving along a web path in a web fabricating system, the system being of the type including a processing station configured to perform an operation on the web resulting in fluctuations in the position of the web from a preselected baseline position, the amplitude of such fluctuations from said baseline position varying in a first direction transverse to a second direction of web travel, the apparatus improved wherein the apparatus comprises:

stabilizer means, disposed proximate the web path immediately downstream of and in the range of 1/16" to 3" from the processing station, for maintaining the amplitude of the fluctuations to within a desired distance range.

23. The apparatus of claim 22 wherein said web fabricating system comprises a printing press and said processing station comprises a blanket cylinder, and wherein:

said baseline position comprises a baseline arc length corresponding to the amount of blanket follow between the web and the blanket cylinder; and said stabilizer means comprises means for controlling said baseline position.

24. The apparatus of claim 23 wherein said stabilizer means comprises a stabilizer bar having a gas outlet, disposed transversely across the web, configured to direct a stream of compressed gas at a surface of the web.

25. The apparatus of claim 22 wherein said stabilizer means comprises a stabilizer bar having a gas outlet, disposed transversely across the web, configured to direct a stream of compressed gas at a surface of the web.

26. The apparatus of claim 24 wherein said stabilizer bar comprises:

a substantially hollow, elongated member having an elongated slot disposed in a surface thereof;

a first strip partially covering said slot and movable with respect thereto;

a second strip partially covering said slot, said first and second strips defining a gas gap therebetween, said gas gap being configured to discharge said compressed gas stream therefrom.

27. The apparatus of claim 25 wherein said stabilizer bar comprises:

a substantially hollow, elongated member having an elongated slot disposed in a surface thereof;

a first strip partially covering said slot and movable with respect thereto;

a second strip partially covering said slot, said first and second strips defining a gas gap therebetween, said gas gap being configured to discharge said compressed gas stream therefrom.

28. The apparatus of claim 22 wherein said stabilizer means is disposed up to four inches from said processing station.

* * * * *